United States Patent [19]

Smith

[11] Patent Number: 4,727,797

[45] Date of Patent: Mar. 1, 1988

[54] SECONDARY WINDOW VENTILATORS

[75] Inventor: Nigel R. Smith, Colchester, England

[73] Assignee: Titon Hardware Limited, Clochester, England

[21] Appl. No.: 881,745

[22] Filed: Jul. 3, 1986

[51] Int. Cl.[4] ..... E06B 7/02

[52] U.S. Cl. ..... 98/98; 98/99.8

[58] Field of Search ..... 98/88.1, 98, 97, 99.01, 98/99.8; 49/220, 209

[56] References Cited

U.S. PATENT DOCUMENTS

| | | | |
|---|---|---|---|
| 945,615 | 1/1910 | Scott | 98/98 |
| 1,233,436 | 7/1917 | Baar | 98/98 |

FOREIGN PATENT DOCUMENTS

| | | | |
|---|---|---|---|
| 110436 | 6/1984 | European Pat. Off. | 98/99.8 |
| 119045 | 3/1970 | Norway | 98/88.1 |
| 141351 | 11/1979 | Norway . | |
| 1417751 | 12/1975 | United Kingdom | 98/88.1 |
| 2083203 | 3/1982 | United Kingdom | 98/88.1 |
| 2113825 | 8/1983 | United Kingdom . | |

*Primary Examiner*—Steven E. Warner

*Attorney, Agent, or Firm*—Millen & White

[57] ABSTRACT

A sliding sash window ventilator assembly for insertion between one sash and the window frame. A ventilation channel is closable by a facing member mounted by a parallel motion linkage for adjustment of its position. The facing member is disposed and mounted such that it fails to extend beyond the overall dimensions of the ventilator assembly even when fully open, to thus avoid obstructing motion of the sashes. Preferably, the facing member is mounted on external flange members of the assembly for ease of construction.

7 Claims, 5 Drawing Figures

SECONDARY WINDOW VENTILATORS

BACKGROUND OF THE INVENTION

This invention relates to ventilators for use in connection with openable windows and other glazing panels, the ventilators being of the type which can be used to provide a degree of ventilation when the openable window is in the closed position. This type of ventilation is usually now referred to as "secondary ventilation". It is particularly important in areas where external temperatures may be low or external weather inclement for use to provide ventilation for dwellings and other accommodation where the high performance seal of modern windows might otherwise give rise to environmental problems such as condensation within the dwelling or accommodation.

SUMMARY OF THE INVENTION

The applicant's assignees have obtained a UK Pat. No. 2,112,825 which describes a ventilator intended to fit in the gap between a window sash and an undersized glazing panel. The ventilator has an upper tongue which fits into the sash in a manner equivalent to that by which the glass itself would be affixed to the sash, the ventilator having a lower channel into which the free edge of the glass locates. The ventilator in that patent is preferably of the type described in UK Pat. No. 1,417,751 of the present applicant's assignees having an elongate slotted backing member and an elongate facing strip mounted by spaced parallel motion links on the backing member, such that lengthwise movement of the facing strip also produces movement thereof towards or away from and parallel to the backing member between a fully closed position obstructing the slot or slots in the backing member and a fully opened position. The Applicant's assignees also have a Norwegian Pat. No. 141,351 which describes a similar type of ventilator but has a linkage arrangement differing slightly from that described in UK Pat. No. 1,417,751.

The present invention has as its object the provision of a secondary ventilator of the parallel motion linkage type for use in relation to sliding sash windows. One of the specific objects of the invention is to provide such an arrangement for post-fitting to existing sliding sash windows where it would be inappropriate or too economically burdensome to reduce the area of glass within a sash for fitment as described in UK Pat. No. 2,113,825. The fact that sashes in a sliding sash window pass closely in relation to one another imposes problems of construction and location of the ventilator not experienced in the pivot window arrangements for which the invention of UK Pat. No. 2,113,825 was primarily directed. Moreover there are problems of assembly of the arrangement disclosed in that patent which the arrangements now disclosed and claimed in this patent application seek to overcome. Finally an object of the present invention is to produce a ventilator of this type particularly for a sliding sash window which has a high degree of commonality of construction and constituent parts whether applied as a post fitting to an existing sliding sash window or to be built into a sash of a sliding sash window in construction.

According to one aspect of the present invention a sliding sash window comprises a window frame, inner lower and outer upper sashes mounted to slide respectively within inner and outer channels in said window frame, and a ventilator located between one sash and said window frame, the said ventilator comprising an elongate ventilator housing having an air passage between its inner and outer faces and an elongate facing member mounted by spaced parallel motion links onto said ventilator housing such that length wise movement of said facing member or strip also produces movement of said facing member towards or away from said housing between a fully closed position obstructing said air passage and a fully open position, said facing member and said linkages being located with respect to said housing and said sashes such that relative movement of said inner and outer sashes is not impeded even when said facing member is in said fully open position.

In a conventional twin sash sliding sash window the two sashes will of course be arranged to slide in channels in the window frame substantially parallel to one another, their adjacent surfaces being in substantially the same plane but of course spaced slightly to allow passage of one sash over another. With the two sashes in the normally closed position the outer sash, that is to say the one which will normally be closer to the exterior of the dwelling or accommodation, will normally have its top bar abutting the top of the window frame and its bottom bar substantially on a level with the top bar of the inner lower sash. The terms "inner" and "outer" are used in relation to that normal disposition of a twin sash sliding window. The terms "upper" and "lower" are used to describe the sashes in those closed positions although it is appreciated that in certain circumstances their positions can substantially be reversed without affecting their identity.

The said ventilator is preferably located between the outer upper sash and the said window frame. To achieve this it can be considered that the outer upper sash is moved down in its channels so that there is a gap between its upper bar and the upper cross piece of the window frame. The said ventilator is constructed and arranged substantially to fill that gap. Where the ventilator is post fitted to an existing sash it may be affixed to the top bar of the upper outer sash, the ventilator housing having an upper part to be received in the channel in the frame in which the upper bar of the sash itself would normally be received. In an alternative form the ventilator may be affixed to the horizontal bar of the frame, the lower part of the housing being provided with a channel for receipt of the upper bar of the outer upper sash.

The ventilator housing is preferably substantially rectangular in overall corss-section. The overall cross-section may be broken into a series of structurally connected box sections, the surfaces of the box sections providing a longitudinally extensive channel let in to one longitudinally extensive horizontal side surface of the rectangle. The said facing strip is preferably disposed wholly within the said rectangular overall cross-section when in the fully opened position. The said facing strip in those circumstances will preferably be located in the said longitudinally extensive channel. The object of this is to enable the ventilator to be left either in its open or closed position without the facing strip (or without any manual grip, handle or whatever which may protrude from it) entering the path of movement of the other sash relative to that sash.

The ventilator housing preferably has longitudinally extending exterior flanges for location of the linkages on the housing. These flanges are preferably substantially horizontal and extend from the housing in the outward or exterior direction. The external flanges provide between them location for the hinge members and substantially ease assembly thereof as the hinge pin can be inserted through holes in the flanges. It will be appreciated that the assembly of the facing strip to the ventilator housing of the ventilators as described in UK Pat No. 8,233,378 is much more intricate and difficult as the hinge pivot/pins are located within the body of the ventilator. At least one of the said exterior flanges may also provide a location point for any elongate exterior hood the intention of which is to prevent or minimise ingress of precipitation, dust or whatever from the exterior to the interior of the building through the ventilator passage way.

The sash window may further have spacer means on the lower bar of said outer upper sash, said spacer providing support for a locking element and location of said locking element adjacent a complementary locking element on the upper bar of said lower sash with said sashes in a disposition relative to one another to close said window.

As indicated previously the ventilator itself in a further form of the invention may comprise the upper bar of the said outer upper sash. This form of the invention will be of particular attraction where the ventilator may be installed during assembly of the window rather than post fitting of the ventilator as previously described.

In accordance with a further aspect of the invention a ventilator for a sliding sash window comprises an elongate ventilator housing having an air passage between its inner and outer faces and an elongate facing strip mounted by spaced parallel motion links onto said ventilator housing such that lengthwise movement of said facing strip also produces movement of said facing strip towards or away from said housing between a fully closed position obstructing said air passage and a fully open position, said ventilator housing having longitudinally extending exterior flanges for location of said linkage on said housing. In this form of the invention the ventilator housing is preferably substantially rectangular in overall cross section, said facing strip and said linkages being located with respect to said housing such that said facing strip in said fully open position is disposed within said rectangular overall cross-section. The ventilator of this aspect of the invention may have any or all of the features as described above in relation to the ventilator of the above described.

The various aspects of the present invention may be put into practice in various ways. Some specific embodiments will not be described, by way of example, with reference to the accompanying drawings in which:

DETAILED DESCRIPTION

Figure 1:
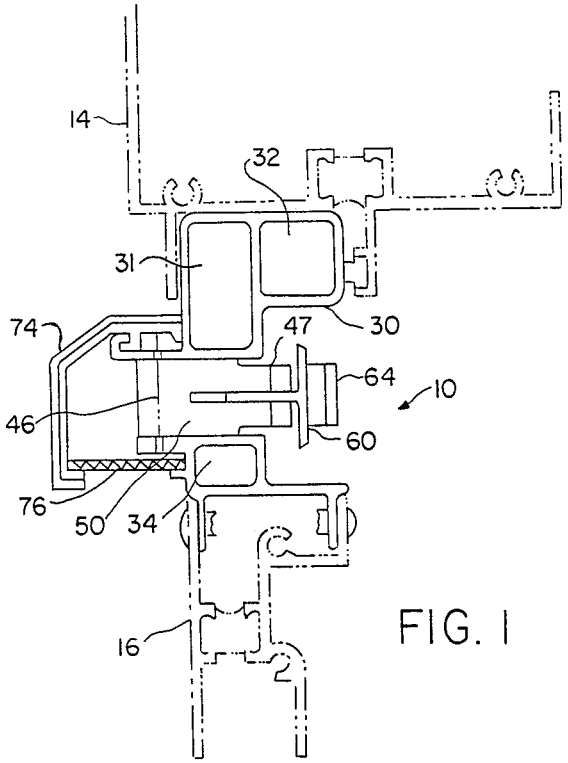
FIG. 1 is a cross-sectional view of a typical ventilator according to one aspect of the invention in position between the top bar of an upper outer sash and the horizontal bar or window frame.

Referring to the drawings a ventilator 10 is located between the upper bar 14 of a window frame and the upper bar 16 of an upper outer sash 18. The lower inner sash 20 will be seen at FIG. 3. The lower bar of the sash 18 is designated 19, the upper bar of the sash 20 is designated 21 and the lower bar of the sash 20 designated 22. The plane of the lower surface of the lower bar of the window frame is designated at 23.

Returning to FIG. 1 the ventilator 10 comprises a housing 30. The housing 30 is an extrusion which extends horizontally along the top bar 16 of the sash 18. The shape of the extrusion will be better seen from inset FIG. 1A. The section comprises four box sections 31 to 34, two exterior longitudinally extending flanges 36 and 38 and an external channel at 40 made up of flanges 41 to 43. A further channel is defined as having two side walls provided by box section 32 and flange 42, and a base wall consisting of sections 33 and 34 and part of section 31.

Figure 2:
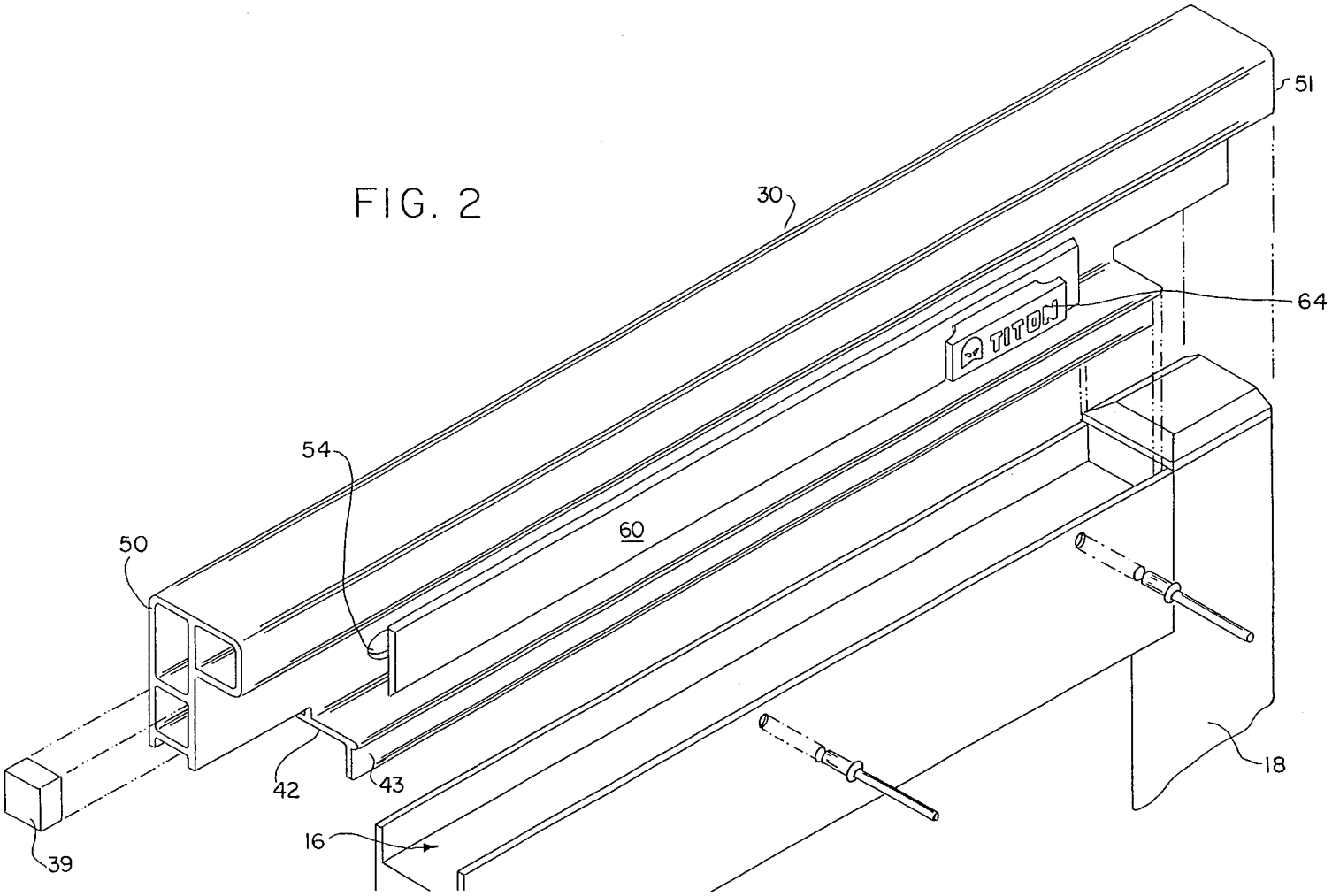
FIG. 2 shows the assembly of a ventilator of that aspect of the invention to the upper bar of a sash window.
Figure 4:
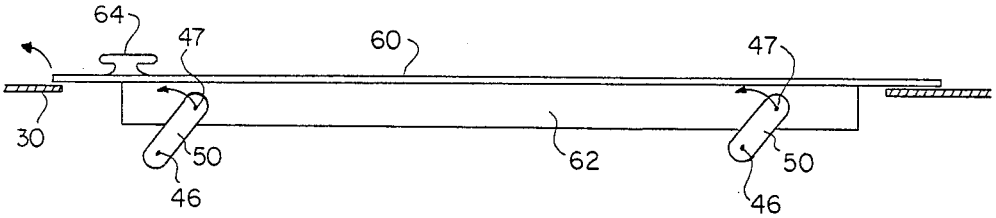
FIG. 4 shows the principal of operation of the parallel motion linkages of the ventilator which forms a part of the present invention.

The side walls of the box 33 are removed over a part of the length of the housing between its distal ends 50 and 51 (see FIG. 2). A part of the slot 54 so formed will be seen on FIG. 2. The section shown at FIG. 1 is taken at a point where the walls of the box 33 have been removed. The parts towards the distal ends 50 and 51 of the section which are not cut provide the structural integrity of the housing. At 39 there is shown a thermal break plug which fits into the recess of box section 33. One is provided at each end of the ventilator to prevent air entering the box section 33 from passing around and into the sash or frame of the window. The housing may be extruded from unplasticised polyvinyl chloride (UPVC) or some similar form retaining plastics material or be made from a metal, such as aluminium. The flanges 36 and 38 are drilled in line with pivot line 46. The U-shaped hinge linkages 50 are inserted between the flanges 36 and 38 and a hinge pin (not shown) located in the drillings on line 46 such that the hinges 50 may pivot freely about the pivot line 46. The ventilator is provided with a facing strip 60 which is a T in section having a rearwardly extending flange 62 over part of its length. The rearwardly extending flange 62 fits between the two arms of the hinge 50 and is connected to the two arms of the hinge 50 through another pivot pin not shown along a pivot line 47. The twin pivots 46 and 47 of each hinge member 50 provide a parallel motion linkage as best shown in FIG. 4. Movement of the facing strip 60 by use for example of the handle or snib 64 in the lefthand direction as shown in FIG. 4 will cause the facing strip 60 to pivot outwards from the housing 30 thereby permitting flow of air around the sides and back of the facing strip 60 and through the channel which exists in the box section 33.

Figure 1A:
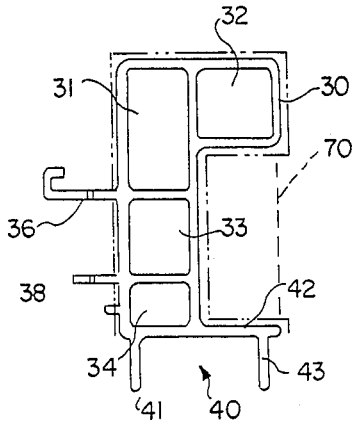
FIG. 1A is a cross-sectional view of the ventilator housing before being cut to take the facing strip and linkages of the ventilator.
Figure 3:
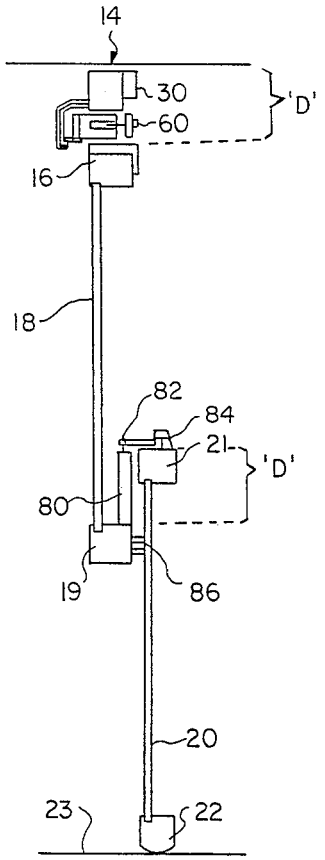
FIG. 3 is a sectional view of a twin sliding sash window according to one aspect of the invention.

It will be appreciated that the facing strip/hinge combination as shown in FIG. 1 is entirely located within the overall rectangular section of the housing 30, that is to say within the chain line 70 as shown in FIG. 1A, over the full range of its movement. In fact, even when fully open, the strip 60 (and its handle 64) is located wholly within the elongate channel defined between section 32 and flange 42, sections 33 and 34, and part of section 31, forming a base of the elongate channel. This means that the two sash windows as shown in FIG. 3 may pass slidably over one another without interference from the ventilator setting.

The ventilator in FIG. 1 is provided with a hood 74 to prevent or minimise ingress of precipitation. The hood is provided with a mesh or grill 76 to prevent ingress of dust, insects and the like. The lateral ends of the hood 74 will be provided with end caps (not shown) to control the flow of air through the ventilator.

The flanges 41 and 43 are affixed by riveting or other suitable means to the top bar 16 of the sash 18. It will be noted that the box section 31 and 32 are substantially the same as the width of the top section 16 so that the ventilator in use occupies the channel in the frame member 14 which would otherwise be normally occuped by the top bar 16 in the sash itself.

In a further embodiment no shown the ventilator housing 30 may be affixed to the top bar 14 of the window frame and the flange/recess arrangement 40 to 43 being modified to receive the upper bar 16 of the sash 18.

Turning now to FIG. 3 the arrangement as shown in FIG. 1 appears at the top part of the drawing. Because of the displacement of the sash 18 a distance D from the frame member 14 the lower bar 19 of the sash 18 will likewise be displaced below the upper bar of the sash 20 by distance D. A spacer 80 is provided to be affixed to the bar 19 such that the conventional latch type locking arrangement 82 may be properly be aligned with its complementary piece 84 affixed to the bar 21 of the sash 20. Furthermore a brush or otherwise flexible plastic seal 86 will be provided on the inner surface of the bar 19 to bear up against the window pane of sash 20 as a seal. If needs be the brush or seal 86 can be supported by a spacer (not shown) attached to the bar 19.

In a further embodiment not shown the recess and flange arrangement 40 to 43 is modified to form the upper bar 16 of the sash 18 for assembly of a window as opposed to post fiting as described above.

In this form of the invention the ventilator assembly is constructed from aluminum or UPVC as suggested above, the aluminium giving greater strength as may be required for the sash itself.

Although not illustrated, it is also possible, in an alternative form of the invention, to mount the ventilator below the bottom bar 22 of the lower sash. This again would cause an offset D between the upper and lower sashes. Of course, the flange 36 cannot in this embodiment extend outwardly for mounting of the hood 74, since the flange extension and hood would interfere with passage of the upper sash.

I claim:

1. A ventilator assembly for sliding sash window comprising an elongate ventilator housing of U-shaped cross-section providing a substantially vertical base portion and two substantially horizontal side portions spaced apart bey said base portion, said base and side portions defining a channel, the housing having an air passage between inner and outer faces of the base portion and an elongate facing member mounted adjacent said inner face by a parallel motion linkage connected to said ventilator housing such that lengthwise movement of said facing member produces movement of said facing member towards or away from said inner face of said housing between a fully closed position obstructing said air passage and a fully open position, said facing member being mounted in said channel between said base and said portions in such manner that even when in its fully open position said facing member remains wholly within said channel.

2. A ventilator assembly as claimed in claim 1 in which said ventilator housing is substantially rectangular in overall cross-section, said facing member and said linkage being located with respect to said housing, such that said facing member in said fully open position is disposed within said rectangular overall cross-section.

3. A ventilator assembly as claimed in claim 1 wherein said housing has longitudinally extending exterior flanges for mounting of said linkage on said housing.

4. A ventilator assembly as claimed in claim 1 wherein said linkage comprises at least two parallel link members pivotably mounted on said facing member.

5. A ventilator assembly for a sliding sash window comprising an elongate ventilator housing of substantially rectangular overall cross-section, having an air passage across said plane of said sash between its inner and outer faces and an elongate facing member mounted adjacent said inner face by a parallel motion linkage such that length-wise movement of said facing member produces movement of said facing member towards or away from said inner face of said housing between a fully closed position obstructing said air passage and a fully open position, said facing member and said linkage being mounted with respect to said housing such that said facing member in said fully open position is disposed within said rectangular overall cross-section, said ventilator housing having exterior flange means for mounting of said linkage on said housing.

6. A ventilator assembly according to claim 5 wherein said flange means comprises at least one longitudinally extending elongate flange member.

7. A ventilator assembly for a sliding sash window comprising an elongate ventilator housing having an air passage across said plane of said sash between its inner and outer faces and an elongate facing member mounted adjacent said inner face by a parallel motion linkage such that length-wise movement of said facing member produces movement of said facing member towards or away from said inner face of said housing between a fully closed position obstructing said air passage and a fully open position, wherein said housing is of U-shaped cross-section providing a base portion and two side portions between which a channel is defined, the facing member mounted between said side portions in such manner that even when in its fully open position said facing member remains wholly within said channel, said ventilator housing having exterior flange means for mounting of said linkage on said housing.

* * * * *